US007794136B2

(12) United States Patent
Yang et al.

(10) Patent No.: US 7,794,136 B2
(45) Date of Patent: Sep. 14, 2010

(54) TWIN-VORTEX MICROMIXER FOR ENFORCED MASS EXCHANGE

(75) Inventors: Jing-Tang Yang, Hsinchu (TW); Kai-Yang Tung, Hsinchu (TW); Wei-Feng Fang, Hsinchu (TW); Ker-Jer Huang, Hsinchu (TW)

(73) Assignee: National Tsing Hua University, Hsinchu (TW)

( * ) Notice: Subject to any disclaimer, the term of this patent is extended or adjusted under 35 U.S.C. 154(b) by 941 days.

(21) Appl. No.: 11/429,972

(22) Filed: May 9, 2006

(65) Prior Publication Data

US 2007/0263485 A1 Nov. 15, 2007

(51) Int. Cl.
*B01F 5/06* (2006.01)

(52) U.S. Cl. ..... 366/336; 366/DIG. 3

(58) Field of Classification Search ..... 366/336, 366/341, DIG. 3, 337, 338, 339, 340; 422/99, 422/100

See application file for complete search history.

(56) References Cited

U.S. PATENT DOCUMENTS 3,476,521 A * 11/1969 Wise ..... 366/336
6,170,981 B1 * 1/2001 Regnier et al. ..... 366/336
6,281,254 B1 * 8/2001 Nakajima et al. ..... 366/340
6,907,895 B2 * 6/2005 Johnson et al. ..... 366/341
7,507,387 B2 * 3/2009 Mae et al. ..... 422/224
2003/0051760 A1 * 3/2003 Johnson et al. ..... 137/896
2004/0262223 A1 * 12/2004 Strook et al. ..... 422/101
2005/0031507 A1 * 2/2005 Mae et al. ..... 422/222
2005/0232076 A1 * 10/2005 Yang et al. ..... 366/336
2007/0017633 A1 * 1/2007 Tonkovich et al. ..... 366/341
2007/0263485 A1 * 11/2007 Yang et al. ..... 366/336

* cited by examiner

*Primary Examiner*—Tony G Soohoo
(74) *Attorney, Agent, or Firm*—Rosenberg, Klein & Lee

(57) ABSTRACT

The present invention discloses a vortex-modulation based micromixer for enforced mass exchange. The micromixer of the present invention comprises a mixing chamber with grooves on one wall thereof and a special-shape barrier on another wall. As different fluids are injected into the mixing chamber respectively from two inlets of the micromixer, the grooves and barriers of the micromixer of the present invention create the constructive interferences to form the active-like agitation of the fluid. For every groove, the flux passed by can be increased via its high pressure gradient. Understandably, the mixing efficiency of the fluids can be greatly improved within a very short distance. At last, the outlet of the micromixer is located in the downstream of the mixing chamber and further is able to connect with other elements. The present invention is entirely a passive micromixer and no additional energy is required. The present invention can apply to a continuous chemical analysis, particularly to a lab-on-a-chip or a micro total analysis system.

16 Claims, 4 Drawing Sheets

TWIN-VORTEX MICROMIXER FOR ENFORCED MASS EXCHANGE

BACKGROUND OF THE INVENTION

1. Field of the Invention

The present invention relates to a passive micromixer, which can uniformly mix at least two fluids within a very short distance.

2. Description of the Related Art

Before, mixing was usually applied to the fields of mechanics and chemistry, such as chemical synthesis and combustion engineering. Because the advance in microelectromechanics brings rapid developments of microfluidics, a revolutionary development of biomedical chemistry is further inspired. Dismissing the original complicated biomedical analysis processes, procedures of standardized analysis are integrated onto a lab-on-a-chip or the micro total analysis system. A system integrating with microelectromechanics, biomedical technology, analytical chemistry, and optoelectronics is able to perform a series of test procedures of mixing, separation, and transportation, and has the advantages of small volume, low cost, parallel-processing capability, rapid response and disposability. According to the abovementioned, a micromixer is thus developed for mixing in microscale. And now, improving the mixing performance of micromixers becomes a focus topic in the fields concerned.

The size of a lab-on-a-chip or a micro total analysis system is generally about several centimeters and the width of the microchannel thereof ranges from tens to hundreds of microns; therefore, the Reynolds number of the system is greatly decreased. Reynolds number is defined to be:

$$Re=\rho DU/\mu$$

wherein ρ is the density of the fluid; D is the width of the microchannel; U is the speed of the fluid; and μ is the viscosity coefficient of the fluid. Reynolds number represents the ratio of the inertial force to the viscous force of a fluid. When the Reynolds number of a fluid is less than 2300, the fluid is in the state of a laminar flow. Another fluid-mixing-related parameter is Péclet constant, which is defined to be $$Pe=Ul/D$$

wherein D is the diffusion coefficient of molecules, and U is the speed of the fluid, and l is the length. Péclet constant represents the ratio of the convection to the diffusion of a fluid. In a macroscopic flow field, a turbulent flow is usually used to implement mixing; however, it no more works in a microscopic laminar-flow system. For a laminar flow, the mixing among different fluids results from diffusion. Nevertheless, the effect of molecular diffusion is much smaller than that of turbulence. Laminar mixing, also referred to as molecular diffusion, occurring inside a channel of only 200 μm wide, no uniform mixing can be obtained even after centimeters for mixing. Such a problem is one of the challenges micromixers have to confront.

Simply speaking, mixing can be regarded as the result of molecular diffusion and can be described with Fick's law for diffusion, which is defined to be:

$$J=-AD\nabla c$$

wherein J is diffusion flux; A is the contact area between two mixed fluids; D is the diffusion coefficient of the molecule of the fluids; c is the concentrations in the fluids; ∇c is the concentration gradient between the fluids. Adjusting the contact area between two mixed fluids or the concentration gradient between the fluids is able to improve the mixing effect; however, the concentration gradient is hard to control. Therefore, the main stream of the current micromixers is focused on enlarging the contact area between two mixed fluids.

The fluid in a microchannel has a pretty high ratio of surface area to volume. Via the structures of geometry, wall grooves, and barriers of a microchannel, secondary flows will be created to influence on the fluid. The flowing mode mentioned can generate massive foldings and stretchings of the fluid and make progress for mixing. Refer to FIG. 1 for a conventional micromixer (WO Pat. Ser. No. 03/011443 A2). In such a well-known passive micromixer 10, grooves 12*a*, 12*b*, 12,*c*, 12*d*, 12*e*, and 12*f* of a special geometrical structure are formed on the bottom wall of the mixing chamber 11 via a lithographic process. This special geometrical structure can create velocity vectors vertical to the flow direction of the fluid to form the helical flow for better mixing by way of the effects of foldings and stretchings.

Refer to FIG. 2 for a perspective view of a special embodiment of the conventional micromixer shown in FIG. 1—a staggered herringbone micromixer 20—and the helical flow field thereof. In the staggered herringbone micromixer 20, the bottom wall of the mixing chamber 23 has periodic and asymmetric structures 21*a* and 21*b*, which can generate two sets of vortices rotating in opposite directions. In the first semi-period, the right vortical bulb 22*a* is smaller than the left vortical bulb 22*b* as the asymmetric structure 21*a* is deviated and rightward (The positive x-axis is the right side, and the negative x-axis is the left side.). In the second semi-period, the right vortical bulb 22*c* is greater than the left vortical bulb 22*d* as the asymmetric structure 21*b* is deviated and leftward. After several cycles, the reciprocating vortical motions enable the fluid to be mixed uniformly. The staggered herringbone micromixer is satisfactory, however, it needs a 3 cm-channel-length to achieve the 90%-mixing-efficiency when the mixing channel is 200 μm wide and 70 μm high. Therefore, the present invention proposes a new micromixer to shorten the length down to millimeter-scale.

SUMMARY OF THE INVENTION

The primary objective of the present invention is to provide a micromixer, which can uniformly mix at least two fluids within a very short distance, such as few millimeters. The microchannel of the micromixer of the present invention is made of silicon, glass, or polymer. The microchannel of the present invention is formed and packaged via microelectromechanical processes, such as the lithographic process. In the present invention, at least one wall of the microchannel has specially-designed grooves, which are inclined to the main flow direction of the fluid by some degrees and are able to create transverse velocity vectors and a unitary vortex for the fluid flowing inside the microchannel.

To improve mixing, the present invention further exerts microstructures inside the micromixer, such as the special-designed barriers and grooves, to induce the helical motion of the mass exchange via generating the three-dimensional flow field as well as the transverse flow of the vertical main flow field. One of the functions of the barriers is to split a unitary vortex into two vortices (a left one and a right one) rotating in the same direction. When the fluid flows downstream, the positions of the barriers shift leftward and rightward alternately so that the barriers can provide transverse circulation disturbance to the fluid. Also, according to the constructive interferences of the barriers and grooves, the dynamic perturbation of the fluid is formed so that, for each groove, the higher pressure gradient can enlarge the flux of itself passed by. Consequently, the mixing efficiency between/among the fluids is greatly improved.

In the present invention, the microchannel's width is less than 1000 μm and its height is less than 500 μm. The groove's width is less than 250 μm and its depth is less than 250 μm. The barrier's width is less than 100 μm and its height is less than 200 μm.

The micromixer of the present invention is applicable to the fluids with Reynolds numbers less than 100 and has a further better mixing performance than other micromixers in the case of smaller Reynolds numbers.

To enable the objectives, technical contents, characteristics and accomplishments of the present invention to be more easily understood, the embodiments of the present invention are to be described below in detailed in cooperation with the attached drawings.

DETAILED DESCRIPTION OF THE INVENTION

Figure 3:
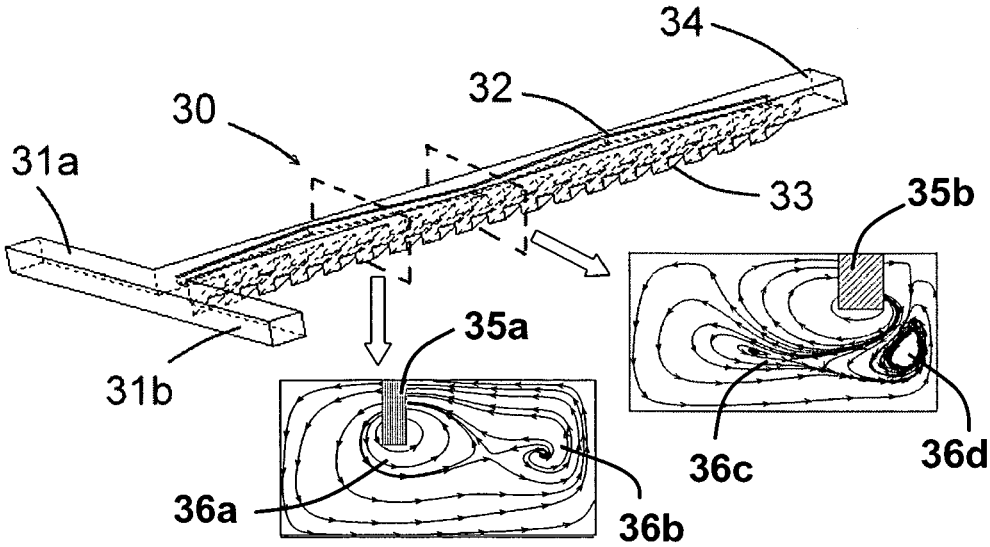
FIG. 3 is a diagram schematically showing a preferred embodiment of the present invention.
Figure 4:
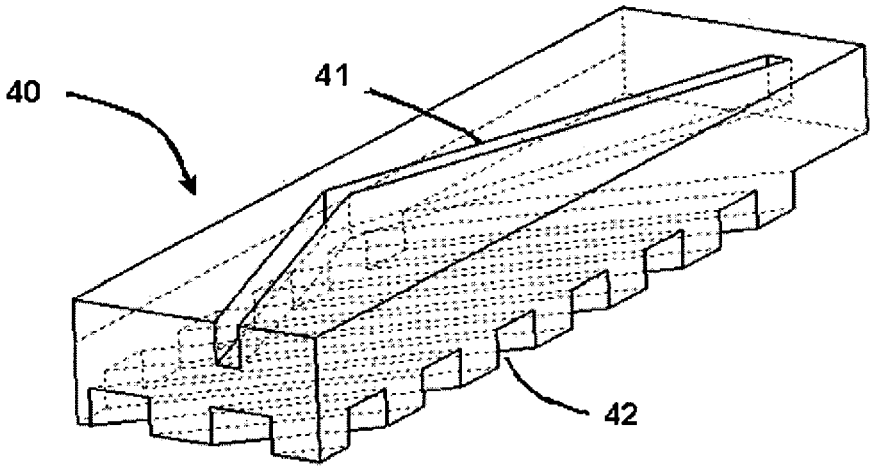
FIG. 4 is an enlargement of the preferred embodiment of the present invention.

The present invention proposes a micromixer for enforced mass exchange. Refer to FIG. 3 a diagram schematically showing a preferred embodiment of the present invention. The mass-exchange-enforcing micromixer 30 comprises: a left inlet 31*a*, a right inlet 31*b*, a mixing chamber 37, and an outlet 34. At least two fluids enter into the mixing chamber 37 of the micromixer 30 via the left inlet 31*a* and the right inlet 31*b* respectively. The fluids are uniformly mixed in the mixing chamber 37, and then, the uniformly mixed fluids leave the micromixer 30 via the outlet 34. On at least one wall of the mixing chamber 37, such as the bottom wall, a lithographic process is exerted to form the grooves 33, which are sunk in the wall by at least tens to hundreds of microns and inclined to the main flow direction by some degrees. The grooves 33 may be simple slanted trenches or lying-V-shape trenches on the surface of the bottom wall. When the fluids flow through the grooves 33, the transverse velocity vectors are formed perpendicular to the main flow direction of the fluids and also the helical motions are further formed. Besides, on at least one wall of the mixing chamber 37, such as the top wall, a lithographic process is exerted to form the barriers 32. From the cross section of the main flow channel, barrier cross sections 35*a* and 35*b* split the unitary vortex created by the grooves 33 on the bottom wall into two uni-direction vortices. Referring to FIG. 4, an enlargement of the inlet of the mixing chamber of the present invention, the structures of the top-wall barriers 41 and the bottom-wall grooves 42 can be perceived more clearly.

In the cross section near the front end of the flowing channel shown in FIG. 3, the barrier cross section 35*a* is closer to the left wall and forms a smaller left-vortical bulb 36*a* and a larger right-vortical bulb 36*b*. When the fluids flow downstream, the top-wallbarrier 32 shifts rightward and the right-vortical bulb 36*b* is compressed to shrink gradually so that a portion of mass of the right vortical bulb exchanges into the left vortical bulb. When the fluids flow to the middle portion of the flowing channel, the left-vortical bulb 36*c* expands to maximum and the right-vortical bulb 36*d* shrinks to minimum. When the fluids keep on flowing downstream, the top-wall barrier 32 shifts leftward again and the left-vortical bulb is compressed to shrink gradually so that a portion of mass of the left vortical bulb exchanges into the right vortical bulb. Repeating the abovementioned transverse motion of the fluids will greatly increase the mixing efficiency.

Figure 5:
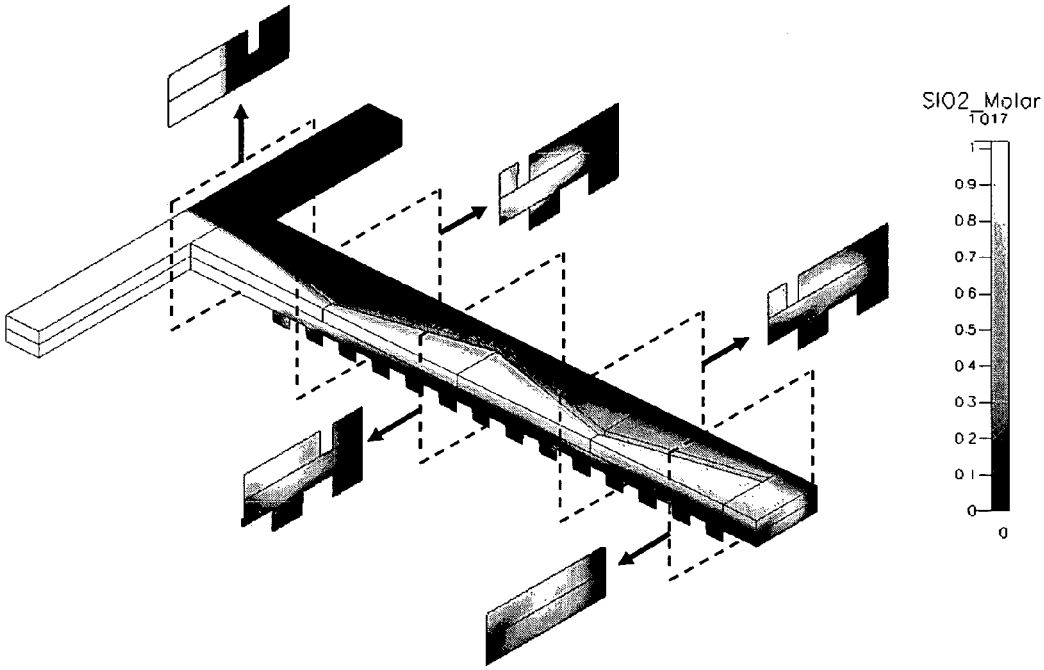
FIG. 5 is a diagram showing the simulation results of the preferred embodiment of the present invention.

The simulation of the mixing process in the micromixer shown in FIG. 3 is calculated with a fluid mechanics software CFD-RC and shown in FIG. 5, wherein black color and white color respectively represent two fluids of different compositions and the mixed fluid has intermediate colors, which are shown in the mixing scale on the right side of FIG. 5. Usually, the mixing scale is determined by a mixing index, which is defined to be as below:

$$Mi = \left(1 - \frac{\int_A |c_i - c_\infty| dA}{\int_A |c_0 - c_\infty| dA}\right)$$

wherein Mi denotes the mixing index and ranges from 0 to 1, and 0 represents that none mixing occurs, and 1 represents that the fluids are mixed completely; $c_i$ denotes the concentration of a composition of the fluid at a certain position; $c_o$ denotes the concentration of the composition of the fluid at the inlet; $c\infty$ denotes the concentration of the composition of the fluid at an infinity point downstream; and A denotes the area of a cross section. Under the same conditions: the Reynolds number is 1, the Péclet constant 2000, the width 200 μm, the height 70 μm, and the length 1700 μm, the comparison between the micromixer for enforced mass exchange of the present invention and the staggered herringbone micromixer shows that the mixing index of the micromixer for enforced mass exchange of the present invention reaches above 0.365, and the mixing index of the staggered herringbone micromixer is only 0.2922. Moreover, the mixing index of the present invention mentioned above is varied with the different arrangements as well as the depths of the barriers.

Figure 1:
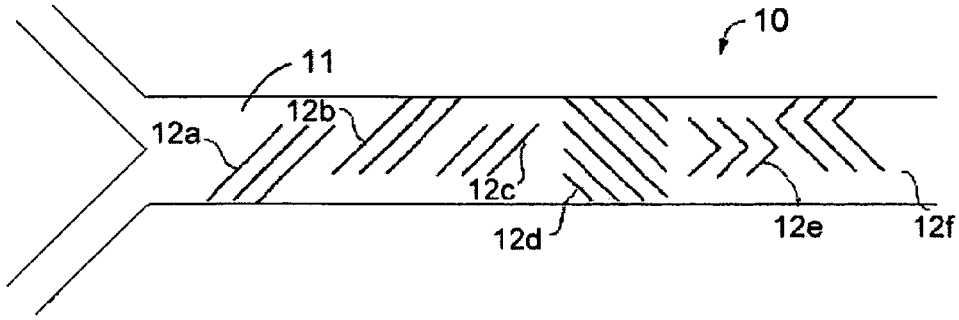
FIG. 1 is a diagram schematically showing a conventional micromixer.
Figure 2:
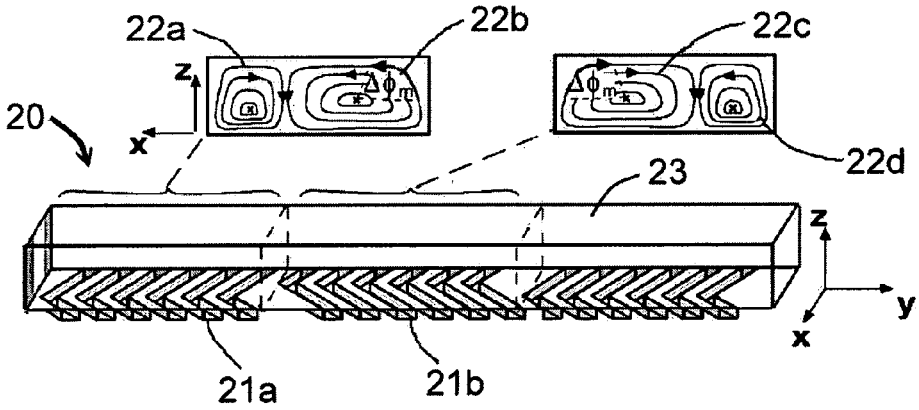
FIG. 2 is a diagram schematically showing the vortical motion inside the micromixer showing FIG. 1.

The staggered herringbone micromixer shown in FIG. 2 creates two stable counter-rotating vortices. As the left and the right vortices of the staggered herringbone micromixer respectively rotate in opposite directions, the fluids inside those two vortices can merely independently flow inside their own vortices, and the mass inside those two vortices is hard to be exchanged. This conventional micromixer has to relay on the periodic structures of the staggered herringbone-like grooves, which are formed leftward and rightward alternately, for higher mixing efficiency. As shown in FIG. 5, the micromixer for enforced mass exchange of the present invention creates two uni-direction vortices. The fluid flowing in one of those two vortices may either flow into the other vortex or return to the original vortex. Further, the barrier structure, which has the ability to shift leftward and rightward alternately, enforces the vortices to exchange the mass. Thus, the contact area between the fluids increases when the fluids flow from upstream to downstream. Furthermore, increasing the height of the barrier can deepen the depth of circulation disturbance and enhance the mass exchange between the vortices so that the mixing index is thus increased. Therefore, the micromixer of the present invention is much superior to the staggered herringbone micromixer theoretically.

Figure 6:
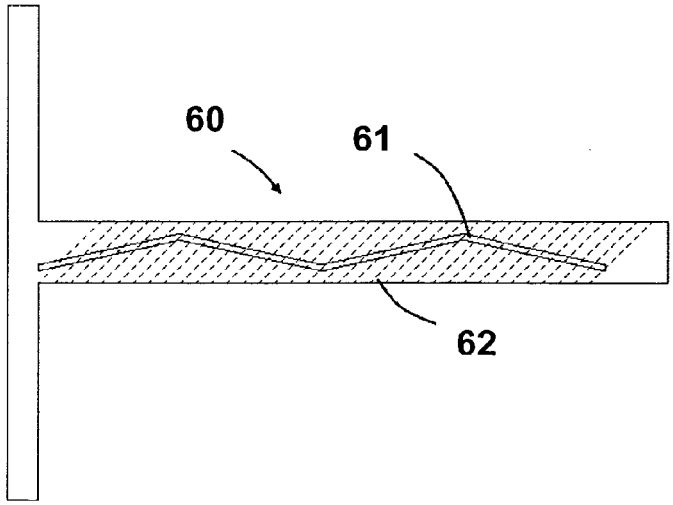
FIG. 6 is a top view of the preferred embodiment of the present invention.
Figure 7:
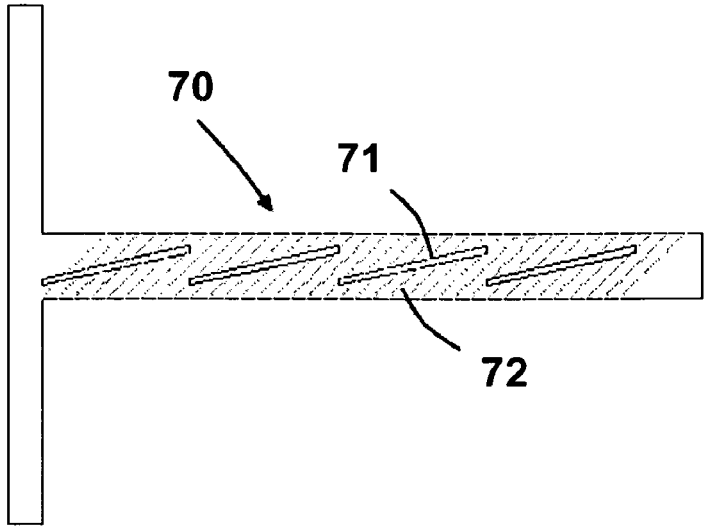
FIG. 7 is a diagram schematically showing a preferred embodiment of the present invention.
Figure 8:
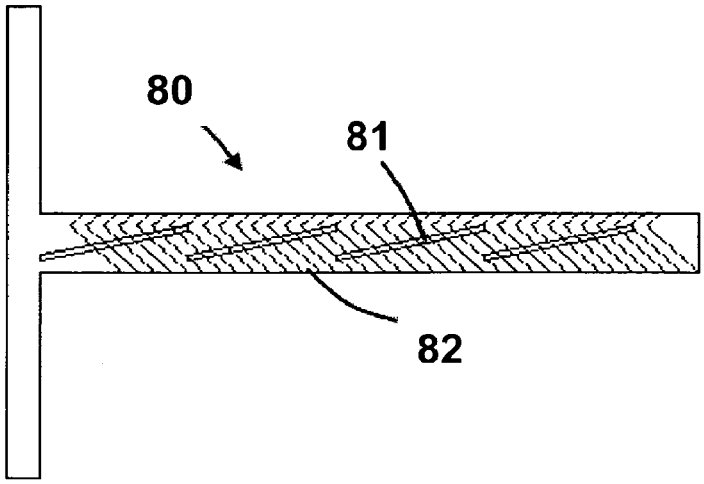
FIG. 8 is a diagram schematically showing a preferred embodiment of the present invention.

Refer to FIG. 6 a top view of the preferred embodiment of the present invention. In the micromixer 60, the structure of the top-wall barrier 61 is similar to a triangular wave, and the bottom-wall grooves 62 are inclined to the main flow channel by some degrees. Refer to FIG. 7 a top view of a preferred embodiment of the present invention. In the micromixer 70, the structure of the top-wall barrier 71 is a series of slanted plates inclined to the main flow channel by some degrees, and the bottom-wall grooves 72 are also inclined to the main flow channel by some degrees. Refer to FIG. 8 a top view of a preferred embodiment of the present invention. In the micromixer 80, the structure of the top-wall barrier 81 is the same as that shown in FIG. 7, and the bottom-wall grooves 72 are similar to a series of lying V's.

In the present invention, a preferred fabrication process for the micromixer is the lithographic process commonly used in fabricating microelectromechanical devices, wherein the structure of the flow channel, including the top-wall barrier and the bottom-wall grooves, is determined via the procedures of photoresist applying, pre-baking, exposure, post-baking, PDMS (polydimethylsiloxane) duplication. At last, the cover and the body of the channel are jointed with a UV-hardened resin or the oxygen plasma to form the end-product of the micromixer.

What is claimed is:

1. A micromixer for enforced mass exchange, comprising:

at least one fluid inlet;

at least one mixing chamber extending in a longitudinal direction, succeeding to and connected to said at least one fluid inlet; and accepting at least two fluids, wherein said fluids have a substantially low Reynolds number, wherein said mixing chamber comprises at least one flow channel;

at least one groove structure for passing fluid therethrough, said groove structure located on at least one wall of said mixing chamber;

at least one barrier structure, located on at least one wall of said mixing chamber opposite from said groove structure, said barrier structure intersecting said fluid flow through said groove structure, said barrier structure extending in alternating displacement directions about said longitudinal direction of said mixing chamber; and at least one fluid outlet, succeeding to and connected to said mixing chamber;

wherein said alternating displacement causes creation of at least one set of twin vortices of mixed fluid flow; said vortices having uni-directional fluid flow in a direction perpendicular to said longitudinal direction of said mixing chamber;

said twin vortices comprising at least two bulbs, wherein said bulbs alternately exchange fluid mass one with the other, as said at least two fluids flow through said mixing chamber;

said alternate exchange of fluid mass corresponding to said alternating displacement directions of said barrier structures.

2. The micromixer for enforced mass exchange according to claim 1, wherein said at least one flow channel of said micromixer is made of silicon, a glass or a polymer.

3. The micromixer for enforced mass exchange according to claim 1, wherein the width and the depth of said at least one flow channel of said micromixer are less than 1000 μm.

4. The micromixer for enforced mass exchange according to claim 1, wherein the angle between said barrier structure and said at least one flow channel ranges from 0 to 90 degrees.

5. The micromixer for enforced mass exchange according to claim 1, wherein the angle between said groove structure and said at least one flow channel ranges from 0 to 90 degrees.

6. The micromixer for enforced mass exchange according to claim 1, wherein the height of said barrier structure is smaller the height of said at least one flow channel of said micromixer.

7. The micromixer for enforced mass exchange according to claim 1, wherein the height of said groove structure is smaller than the width of said at least one flow channel of said micromixer.

8. The micromixer for enforced mass exchange according to claim 1, wherein the cross section of said at least one flow channel of said mixing chamber is either a polygon or a circle.

9. The micromixer for enforced mass exchange according to claim 1, wherein said groove structure is a series of slanted trenches or a series of lying-V-shape trenches.

10. The micromixer for enforced mass exchange according to claim 1, wherein the proper range of Reynolds number for said at least two fluids in said micromixer is from 0.01 to 100.

11. The micromixer for enforced mass exchange according to claim 1, wherein said at least two fluids are driven by pressure, electrophoresis, magnetism, or particles.

12. The micromixer for enforced mass exchange according to claim 1, which may be an independent element or a member of a fluidic network.

13. The micromixer for enforced mass exchange according to claim 1, wherein the position of said barrier structure shifts leftward and rightward alternately along said at least one flowing channel.

14. The micromixer for enforced mass exchange according to claim 13, wherein the shape of said barrier structure is selected from the group consisting of periodic triangular wave, trigonometric-function wave (such as a sinusoidal wave), periodic zigzag wave, and periodic trapezoid wave.

15. The micromixer for enforced mass exchange according to claim 13, wherein said barrier structure is either continuous or discontinuous.

16. The micromixer for enforced mass exchange according to claim 13, wherein the angle between said barrier structure and the surface of said at least one flowing channel ranges from 0 to 90 degrees.

* * * * *